US008579618B2

(12) United States Patent
Abu Samra et al.

(10) Patent No.: US 8,579,618 B2
(45) Date of Patent: Nov. 12, 2013

(54) INTERNAL GEAR PUMP WITH OPTIMIZED NOISE BEHAVIOUR

(75) Inventors: Muneer Abu Samra, Gainsville, GA (US); Gernot Riegert, Eriskirch (DE); Florian Steinberger, Aulendorf (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 739 days.

(21) Appl. No.: 12/630,029

(22) Filed: Dec. 3, 2009

(65) Prior Publication Data

US 2010/0143175 A1 Jun. 10, 2010

(30) Foreign Application Priority Data

Dec. 10, 2008 (DE) ..... 10 2008 054 474

(51) Int. Cl.
*F01C 1/10* (2006.01)
*F04C 2/10* (2006.01)
*F04C 18/10* (2006.01)

(52) U.S. Cl.
USPC ..... 418/170; 418/166; 418/169; 418/171

(58) Field of Classification Search
USPC ..... 418/166, 75–77, 169–171
See application file for complete search history.

(56) References Cited

U.S. PATENT DOCUMENTS

| | | | | |
|---|---|---|---|---|
| 2,684,637 | A * | 7/1954 | Erikson | 418/170 |
| 2,774,309 | A * | 12/1956 | Stoyke et al. | 418/170 |
| 3,291,060 | A | 12/1966 | Bottoms | |
| 3,679,335 | A | 7/1972 | Zoppel et al. | |
| 5,660,531 | A * | 8/1997 | Merkle et al. | 418/170 |
| 6,089,841 | A * | 7/2000 | Meernik et al. | 418/170 |
| 6,183,229 | B1 * | 2/2001 | Friedmann | 418/170 |
| 6,672,850 | B2 | 1/2004 | Palazzolo et al. | |
| 7,625,192 | B2 * | 12/2009 | Saito et al. | 418/170 |
| 2001/0041144 | A1 * | 11/2001 | Buchmuller et al. | 418/170 |
| 2003/0118454 | A1 * | 6/2003 | Palazzolo et al. | 417/53 |

FOREIGN PATENT DOCUMENTS

| | | | |
|---|---|---|---|
| DE | 19 14 444 | B | 10/1970 |
| DE | 34 48 252 | A1 | 5/1985 |
| DE | 43 41 356 | A1 | 6/1994 |
| WO | WO 2006136014 | A1 * | 12/2006 |

* cited by examiner

*Primary Examiner* — Mary A Davis
(74) *Attorney, Agent, or Firm* — Davis & Bujold, PLLC; Michael J. Bujold

(57) ABSTRACT

An internal gear pump (1) is proposed for conveying a fluid by a driven pump gear wheel (3) and a ring gear (4), as a gear pair residing in an enclosure, which are, for instance, meshing and hereby generating a sealed area. Hereby, viewed cross-sectionally, a sickle shaped part (5) is provided for sealing the free space, located nearly opposite to the sealed area, whereby a first end piece (12) and a second end piece (13) of the part (5) are assigned to a high pressure area. In accordance with the invention, the two end pieces (12, 13) of the part (5) are constructed differently.

15 Claims, 2 Drawing Sheets

INTERNAL GEAR PUMP WITH OPTIMIZED NOISE BEHAVIOUR

This application claims priority from German application serial no. 10 2008 054 474.4 filed Dec. 10, 2008.

FIELD OF THE INVENTION

The present invention concerns an internal gear pump for conveying a fluid.

BACKGROUND OF THE INVENTION

Internal gear pumps mainly comprise an enclosure in which a gear wheel pair, having the smallest possible axial and radial play, is engaged and meshed for conveying a fluid, i.e., a pressure fluid or the like. Hereby, the suction side or lower pressure side, respectively, of the inner gear pump is linked to a fluid container, and the pressure side, or high pressure side, respectively, is linked with the hydro system which needs to be supplied. The gear wheel pair is formed by a inner rotor gear wheel and by a ring gear. The inner rotor gear wheel is driven by a motor, for instance, whereby the rotor gear, due to an active gear engaging, is turning and rotating the outer ring gear. Through this rotation, the gear teeth diverge from another and clear again the tooth gaps. The resulting vacuum and the additional atmospheric pressure on the fluid surface level, in the fluid container, cause the fluid to be drawn in. The drawn in fluid fills the created tooth gap space, which generates, after continued motion, self-contained, filled chambers, and is conveyed further to the pressure side. There, the teeth again mesh and displace the fluid from the filling chambers. The meshing teeth do not allow a return flow of the fluid from the pressure side to the suction side. In addition, the high pressure section is separated from the low pressure section by sealing teeth of the sickle.

For instance, through the publication DE 34 48 252 C2 an internal gear pump using a hydraulic liquid is known in the art in which gear wheels with overlapping, cutting tip circles are being used, which guarantees surface contact of the sealing flanks of the gearing teeth. In addition, a separating sickle is positioned in the available free space, between the intersection of the tip circles. The separating sickle is, in the known internal gear pump embodiment, constructed so that both end pieces are designed identically so that a symmetrical separating sickle is achieved.

A problem with these internal gear pumps is the occurrence of cavitation. This problem can be solved through an enlargement of the inlet area, by improving the filling and the timing, and also by providing additional pump inlets. However, these measures cause, especially with automatic transmissions, disadvantages which are induced because of a resulting increase in the required installation space and the manufacturing cost. There are also other limitations present in such a transmission system utilizing internal gear pumps. These limitations also influence the embodiment of the pump so that it is difficult to optimize the internal gear pump in regard to cavitations and avoiding the noise, without here increasing the dimensions of the internal gear pump.

SUMMARY OF THE INVENTION

Therefore, the inventive task is based on proposing of an internal gear pump, as in the above genus, where unwanted noise is avoided without increasing the required installation space.

The basic task of this invention is solved through an internal gear pump for conveying a fluid comprising a driven pump gear or rotor gear, respectively, and a ring gear, in an enclosure and which partially mesh and which form a sealed area. Further, there is at least a sickle shaped part present for sealing the free, available area, opposite of the area to being sealed, whereby the first end of the part is assigned to a low pressure area, and a second end of the part is assigned to the high pressure area. In accordance with the invention, the two end pieces of the part are constructed differently.

Through the differently developed end pieces of the sickle shaped part, the filling at the low pressure side, or suction side, respectively, and also the outflow at the high pressure side, or pressure side, respectively, is significantly improved so that cavitations and the related generation of noise, in accordance with the invented internal gear pump, is avoided or at least reduced. The beginning of the cavitation is, therefore, moved, as a result of the different embodiments of the end pieces of the sickle shaped part, toward the higher rotational speed.

In accordance with a preferred embodiment of this invention, it is provided that at the low pressure side end piece of the sickle shaped part, or the like, the inlet area is modified in a way that the filling of the filling chambers is significantly improved so that, even at a higher pump rotational speed, a complete and possibly a fast filling of the filling chambers is ensured.

Preferably and as part of the modification, a tangential inlet area is provided. As an example, the path of the inlet area follows tangentially into the inner radius of the sickle shaped part. It was shown that such a path enables an especially well performing inflow of fluids. Through it, a turbulent flow and turbulences are avoided with the stream of the fluid. The path of the inlet area is also varied hereby to obtain an influence when facing a modified pump embodiment.

Alternatively, or also in addition, it is intended that an axially arranged filling duct or the like, for instance, is positioned at the low pressure end of the part. Hereby, a possible drop of the pressure, due to an occurring suction resistance, especially at higher speed of rotation through the axially running filling ducts, is avoided. As an example, a first filling duct is positioned radial at the inner side, in correlation to the part, and preferably a second filling duct is positioned at the outer side of the part. Also, other options are possible as filling ducts.

The axial path of the filling duct taking places at a predetermined angle, whereby the angle is selected in a manner so that, if possible, a turbulence free stream of the fluid is realized.

The alterations or modifications of this invention, respectively, at the pressure side or high pressure side of the internal gear pump, are able to generate compensation of the earlier pressure. Through such measure, cavitations are also avoided, or at least improved, in the proposed pump, as well as the correlating generation of noise.

As an example, it is provided that the high pressure side end piece of the part has at least an axial sloping bevel or the like for the purpose of being an outlet area. The provided bevel preferably has a continuous or a steady progression at a predetermined angle, for instance, axial into the inner part of the enclosure. It is also possible to use a discontinuous or non steady progression, or the like.

In an advantageous embodiment of this invention, it was shown that, regarding the dimensions of the bevel, a length having a corresponding width of the rotor gear is especially advantageous. Other lengths or dimensions of the bevel are also possible. Hereby, when determining the dimensions of the bevel, it is advantageous to consider the characteristics of the internal gear pump. For instance, the amount of the teeth that have a sealing effect in the rotor gear and/or the ring gear of the internal gear pump, are considered.

The proposed modifications at the sickle shaped part of the internal gear pump altogether improve the filling and reduce cavitations, while fluid characteristics are evenly maintained. Each proposed measure, for itself optimizes the internal gear pump in regard to developing cavitations and noise. The geometric modifications at the ends of the part are individually selected, depending on inlet pressure, the outlet pressure, the temperature of the fluid, and/or the rotation of the pump. Hereby, the measures in this invention increase the amount of working volume in the upper rotational speed area of the internal gear pump. In addition, the pressure gradient at the outlet area is reduced and, therefore, a significant reduction in the noise of the internal gear pump is achieved.

The internal gear pump, in accordance with the invention, is hereby operated within a large rotational speed range, in comparison to internal gear pumps known in the art, at little noise generation, or at the same rotational speed or at least similar noise generation with a correlating larger rotation speed, respectively. Through the inventive embodiment of the sickle shaped part of the inlet and outlet area, the internal gear pump is operated at lower, as well as at a higher pump rotational speed, at a minimal noise combined with a minimal volume flow loss.

BRIEF DESCRIPTION OF THE DRAWINGS

In addition, the invention is being further described with the drawings. Being shown in.

DETAILED DESCRIPTION OF THE PREFERRED EMBODIMENTS

Figure 1:
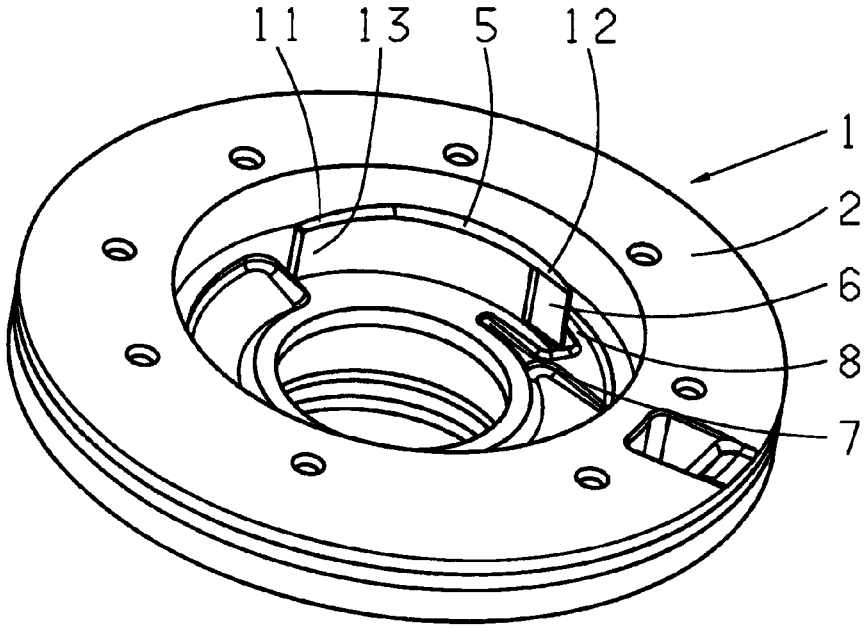
FIG. 1 is a perspective, partial view towards the inner part of the enclosure, without a pump gear wheel and a ring gear, in accordance with the invention.

In FIG. 1 to FIG. 5, different perspective partial views of possible embodiments of this invention for the internal gear pump 1 are presented. For instance, the internal gear pump 1 can be applied to a vehicle automatic transmission, for converting a mechanical behavior, in the form of torque at a rotating shaft, into a hydraulic power. Thus, a higher predetermined pressure level can set for a fluid, such as oil. In this presented exemplary internal gear pump 1, the construction of the pump gear 3 is counter-clockwise. Hereby, the drawing plane shows the low level pressure side or suction side, respectively, on the right hand side and the high pressure side or pressure side, respectively, on the left hand side.

The internal gear pump 1 comprises an enclosure 2 in which the pump gear 3, driven by a drive shaft, and the ring gear 4 are rotatably mounted. The pump gear 3 and the ring gear 4 form a meshing area and a sealing area. Opposite the sealing area, a free space located in the intersection of the gearing's tip circle of the pump gear 3 and the ring gear 4, is sealed by, as a profile, a sickle shaped part 5.

A first end piece 12 of the part 5 is assigned to a low pressure area, or suction area, respectively, of the internal gear pump 1. A second end piece 13 of the part 5 is assigned to a high pressure area, or pressure side, respectively, of the internal gear pump 1.

In accordance with the invention, the two ends 12, 13 of the sickle shaped part 5 are designed differently, for avoiding any cavitation and the resulting noise generation, in the internal gear pump 1, without increasing the available installation space.

Figure 2:
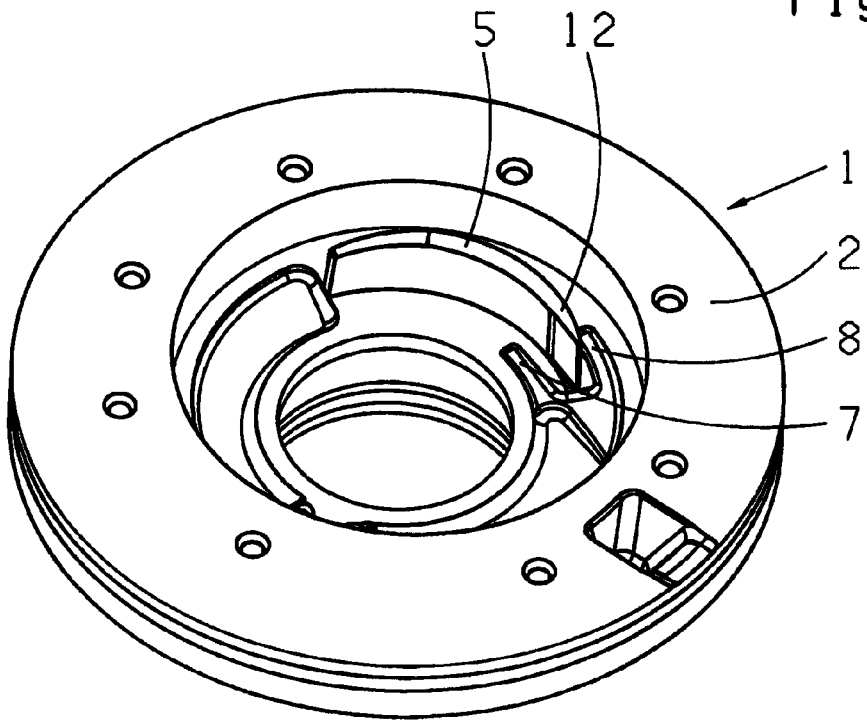
FIG. 2 is a perspective view of a low pressure end piece of the sickle shaped element, in accordance with FIG. 1.

As it is seen in FIG. 1 and FIG. 2, a somewhat tangential inlet area 6 is included at the low pressure end piece 12 of the element 5. This inlet area 6 is designed in a way that it follows into the inner radius of the sickle shaped part 5, which is particularly seen in FIG. 3. By this crescent-shaped, sickle shaped inlet side duct, as inlet area 6, the flow characteristics of the streaming fluid are improved to enhance the filling process and hereby to avoid turbulences, or to reduce them, respectively.

An additional measure, in regard to the invention, is achieved by arranging a first filling duct 7, at the low pressure end piece 12 of the part 5, radial and on the inside of part 5 and a second filling duct 8, radial and on the outer side of part 5. The two filling ducts 7 and 8 run sloping, or at a predetermined angle, respectively, in relation to the axial direction. Hereby, the filling of the filling chambers 9, 10, at the pump gear wheel 3 and the ring gear 4 of the internal gear pump 1, are further optimized. The corresponding lengths of the filling ducts 7, 8 are matched to the parameters of the internal gear pump 1 and also to the characteristics of the fluid which is used.

Figure 3:
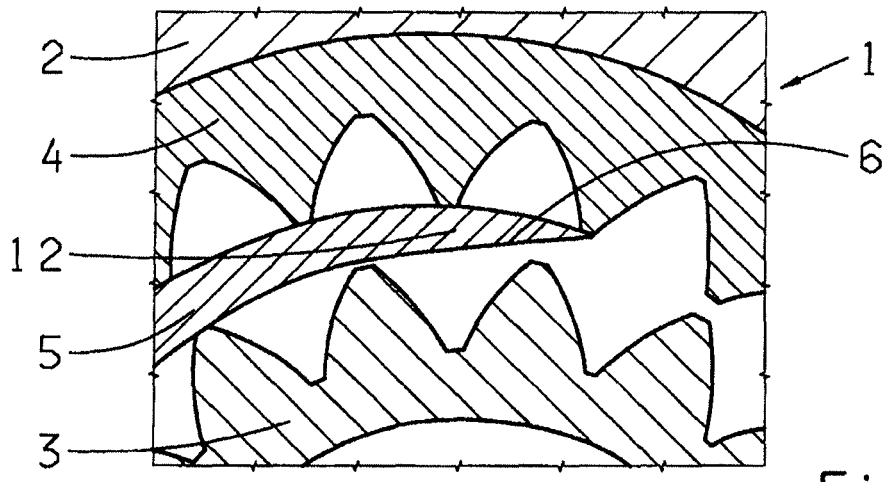
FIG. 3 is a perspective view of a low pressure end piece of the sickle shaped element comprising the pump gear wheel and the ring gear.
Figure 4:
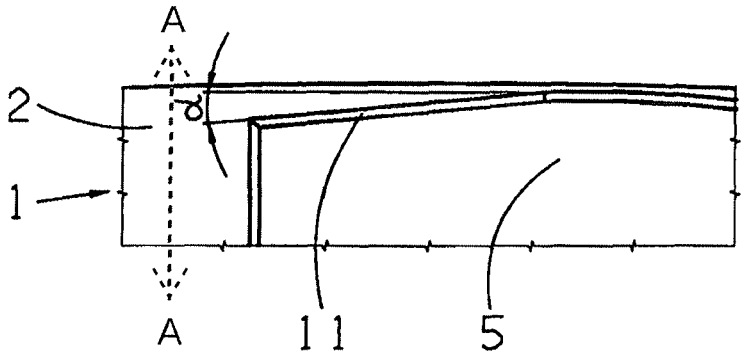
FIG. 4 is a perspective side view of a high pressure side end piece of the sickle shaped element.
Figure 5:
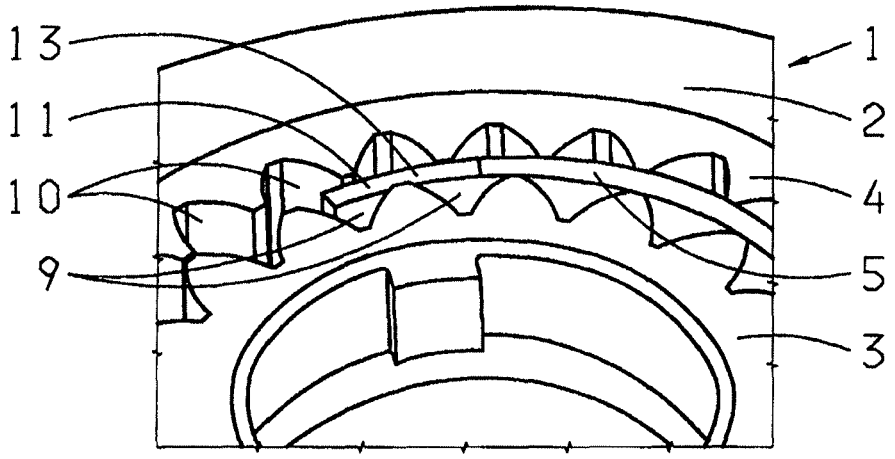
FIG. 5 is a perspective view of the high pressure end piece of the sickle shaped part, comprising the pump gear wheel and the ring gear.

Another measure, taken in regard to this invention, is seen in FIG. 3 to FIG. 5. They present perspective partial views, especially of the high pressure end piece 13 of the part 5, meaning the pressure side of the internal gear pump 1. The high pressure end piece 13 of the part 5 shows at least one bevel 11 as an outlet area, sloping in the axial direction of axis A. The bevel 11, also called a chamfer, has a continuous path at a predetermined angle. This fact is especially indicated in FIG. 4. The length of the bevel 11 corresponds approximately to the width of two filling chambers 9, 10.

A crescent-shaped, sickle shaped outlet side duct is formed as an outlet area. Hereby, the characteristics of the exiting fluid are improved and the pressure gradient is reduced. Also, the operating noise of the internal gear pump 1 is therefore reduced. In addition, at higher rotational speeds, the efficiency of the internal gear pump is improved.

REFERENCE CHARACTERS

1 Internal Gear Pump
2 Enclosure
3 Pump Gear Wheel
4 Ring Gear
5 Sickle Shaped Part
6 Inlet Section
7 First Feeder Duct
8 Second Feeder Duct
9 Filling Chambers of the Pump Gear Wheel
10 Filling Chambers of the Ring Gear
11 Bevel
12 First, low pressure side end of the part
13 Second, high pressure side end of the part
$\alpha$ Angle of Bevel

The invention claimed is:

1. An internal gear pump (1) for conveying fluid, the internal gear pump comprising:

an enclosure (2);

a driven pump gear wheel (3) and a ring gear (4) being located within the enclosure (2);

the driven pump gear wheel (3) and the ring gear (4) at least partially meshing with one another;

a sickle shaped element (5) being located within a free space of the enclosure for creating a sealing area, and the sickle shaped element (5) being immovably and fixedly secured to the enclosure (2);

a first end piece (12) of the sickle shaped element (5) being located in a low pressure area of the gear pump (1);

a second end piece (13) of the sickle shaped element (5) being located in a high pressure area of the gear pump (1);

the first and the second end pieces (12, 13) of the sickle shaped element (5) having different shapes from one another and being designed for avoiding cavitation and minimizing generation of noise during operation of the internal gear pump (1);

tips of the driven pump gear wheel (3) define a circumference of the driven pump gear wheel (3); and an inner circumference of the first end piece (12) of the sickle shaped element (5) being spaced from the tips of the driven pump gear wheel (3) and extending tangentially with the circumference of the driven pump gear wheel (3) so as to form a tangential inlet area (6) which enhances a filling process of the driven pump gear wheel (3) and minimizing turbulence.

2. The internal gear pump according to claim 1, wherein a path of the inlet area (6) extends tangentially from the inner circumference of the sickle shaped element (5).

3. The internal gear pump according to claim 1, wherein at least a first filling duct (7, 8), which has a predetermined angle with regard to an axial direction at the first end piece (12) of the sickle shaped element (5), is provided.

4. The internal gear pump according to claim 3, wherein the first filing duct (7) is positioned inside, in a radial direction, with respect to the sickle shaped element (5).

5. The internal gear pump according to claim 3, wherein a second filling duct (8) is positioned outside, in a radial direction, with respect to the sickle shaped element (5).

6. The internal gear pump according to claim 1, wherein an outlet area of the second end piece (13) of the sickle shaped element (5) has at least one bevel (11) which slopes, in an axial direction, toward the driven pump gear wheel (3).

7. The internal gear pump according to claim 6, wherein the bevel (11) has a continuous path, at a predetermined angle ($\alpha$), extending in the axial direction toward an inner area of the enclosure (2).

8. The internal gear pump according to claim 7, wherein a length of the bevel (11) corresponds with a width of approximately two filling chambers (9) of the pump gear wheel (3).

9. The internal gear pump according to claim 6, wherein a length of the bevel (11) corresponds with a width of approximately two filling chambers (9) of the pump gear wheel (3).

10. The internal gear pump according to claim 1 wherein an outer circumference of the first end piece (12) is arranged so as to continuously engage with tips of the ring gear (4) and seal a plurality of filling chambers (10), which are formed in the ring gear (4), before sealing a plurality of filling chambers (9) which are formed in the pump gear wheel (3).

11. An internal gear pump (1) for conveying fluid, the internal gear pump comprising:

an enclosure (2);

a driven pump gear wheel (3) and a ring gear (4) being located within the enclosure (2), and both the driven pump gear wheel (3) and a ring gear (4) defining a plurality of filling chambers (9, 10) therein;

the driven pump gear wheel (3) and the ring gear (4) at least partially meshing with one another, a sickle shaped element (5) being located within a free space of the enclosure (2) for creating a sealing area, and the sickle shaped element (5) being immovably and fixedly secured to the enclosure (2);

a first end piece (12) of the sickle shaped element (5) being located in a low pressure area of the gear pump (1);

a second end piece (13) of the sickle shaped element (5) being located in a high pressure area of the gear pump (1);

the first and the second end pieces (12, 13) of the sickle shaped element (5) having different shapes from one another and designed for avoiding cavitation and minimizing generation of noise during operation of the internal gear pump (1);

tips of the driven pump gear wheel (3) define a circumference of the driven pump gear wheel (3); and an outer circumference of a leading end of the first end piece (12) of the sickle shaped element (5) continuously engaging with adjacent tips of the ring gear (4) for sealing the plurality of filling chambers (10), an inner circumference of the second end piece (13) of the sickle shaped element (5) being located adjacent tips of the driven pump gear wheel (3) while an inner circumference of the leading end of the first end piece (12) of the sickle shaped element (5) being tangential with the circumference of the driven pump gear wheel (3) and gradually extending toward and sealing against adjacent tips of the driven pump gear wheel (3) so as to form a tangential inlet for the plurality of filling chambers (9) of the driven pump gear wheel (3) located at the first end piece (12) of the sickle shaped element (5) which enhances a filling process of the driven pump gear wheel (3) and minimizes turbulence.

12. An internal gear pump (1) for conveying fluid, the internal gear pump comprising:

an enclosure (2);

a driven pump gear wheel (3) and a ring gear (4) being located within the enclosure (2), and both the driven pump gear wheel (3) and a ring gear (4) defining a plurality of filling chambers (9, 10) therein;

the driven pump gear wheel (3) and the ring gear (4) at least partially meshing with one another, a sickle shaped element (5) being located within a free space of the enclosure (2) for creating a sealing area, and the sickle shaped element (5) being immovably and fixedly secured to the enclosure (2);

a first end piece (12) of the sickle shaped element (5) being located in a low pressure area of the gear pump (1);

a second end piece (13) of the sickle shaped element (5) being located in a high pressure area of the gear pump (1);

the first and the second end pieces (12, 13) of the sickle shaped element (5) having different shapes from one another and designed for avoiding cavitation and minimizing generation of noise during operation of the internal gear pump (1);

an inner circumference of the second end piece (13) of the sickle shaped element (5) being located adjacent tips of the driven pump gear wheel (3) while an inner circumference of the leading end of the first end piece (12) of the sickle shaped element (5) being tangential with the circumference of the driven pump gear wheel (3) and gradually extending toward and sealing against adjacent tips of the driven pump gear wheel (3) so as to form a tangential inlet for the plurality of filling chambers (9) of the driven pump gear wheel (3); and an outlet area of the second end piece (13) of the sickle shaped element (5) having at least one bevel (11), of a constant thickness, which slopes in an axial direction toward the driven pump gear wheel (3) and away from the ring gear (4).

13. The internal gear pump according to claim 12, wherein the bevel (11) has a continuous slope at an angle (a) which extends toward a radially inner area of the enclosure (2).

14. The internal gear pump according to claim 13, wherein a length of the bevel (11) corresponds with a width of approximately two filling chambers (9) of the pump gear wheel (3).

15. The internal gear pump according to claim 12, wherein a length of the bevel (11) corresponds with a width of approximately two filling chambers (9) formed in the pump gear wheel (3).

* * * * *